US006447350B2

(12) United States Patent
Thompson et al.

(10) Patent No.: US 6,447,350 B2
(45) Date of Patent: Sep. 10, 2002

(54) TRANSOM SAVER APPARATUS

(76) Inventors: James L. Thompson, 596 County Rd. 62, Berry, AL (US) 35546; Richard L. Walker, 254 County Rd. 30 East, Berry, AL (US) 33546

( * ) Notice: Subject to any disclaimer, the term of this patent is extended or adjusted under 35 U.S.C. 154(b) by 0 days.

(21) Appl. No.: 09/854,642

(22) Filed: May 14, 2001

Related U.S. Application Data

(60) Provisional application No. 60/204,762, filed on May 17, 2000.

(51) Int. Cl.[7] ..... B63H 5/125
(52) U.S. Cl. ..... 440/55; 248/642
(58) Field of Search ..... 248/640, 642; 440/53, 55, 113

(56) References Cited

U.S. PATENT DOCUMENTS 3,693,576 A * 9/1972 Driscoll ..... 248/642
3,941,344 A * 3/1976 Paterson ..... 248/351
4,271,548 A 6/1981 Alberts
4,331,431 A 5/1982 Estes
4,381,069 A 4/1983 Kreck
4,685,888 A 8/1987 Brewer
4,828,186 A * 5/1989 Weiss ..... 248/640
5,021,016 A * 6/1991 Currey ..... 248/640
5,031,842 A * 7/1991 Mohr ..... 248/351
5,525,082 A 6/1996 Lee

* cited by examiner

*Primary Examiner*—Sherman Basinger

(57) ABSTRACT

A transom saver apparatus is adapted to be attached to a boat trailer and includes a pivot assembly adapted to be connected to a first portion of the trailer. An arm assembly is provided having first and second opposed ends wherein one end is connected to the boat trailer connection pivot assembly and the other end terminates in an outboard motor rest or support member. The arm assembly includes a first telescopic arm member, and a second telescopic arm member in telescopic engagement with the first telescopic arm member such that the second telescopic arm member defines the second distal end of the arm assembly and the second distal end comprises the outboard motor rest member. An arm rest bracket assembly is further included attachable to a second portion of the boat trailer for receivingly supporting the pivotal arm assembly in an out-of-the-way orientation when the arm assembly is not pivotally disposed in a use orientation.

6 Claims, 6 Drawing Sheets

FIG 1
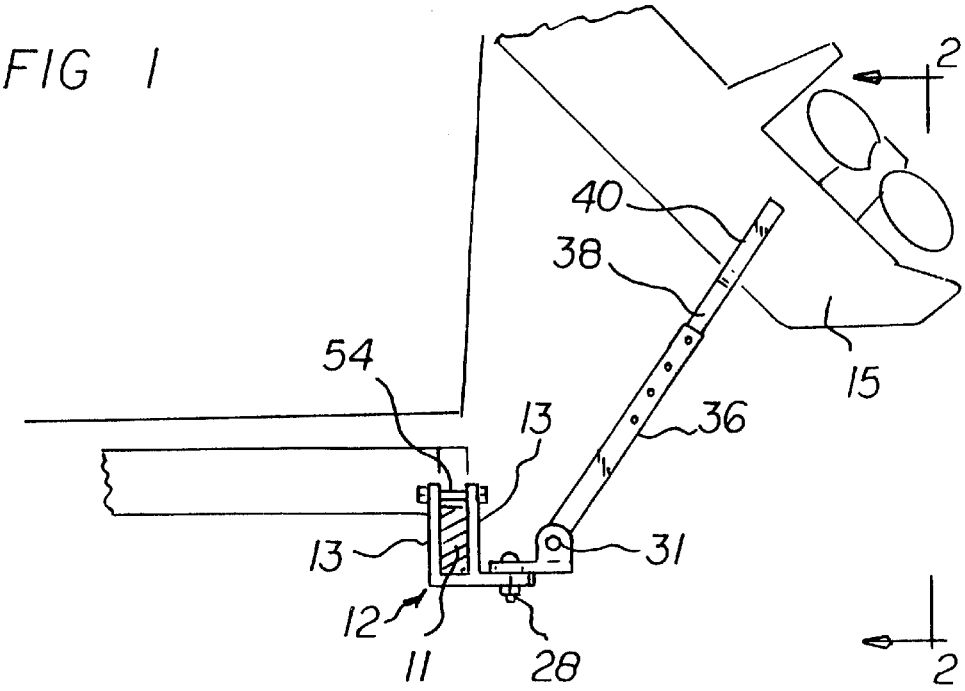
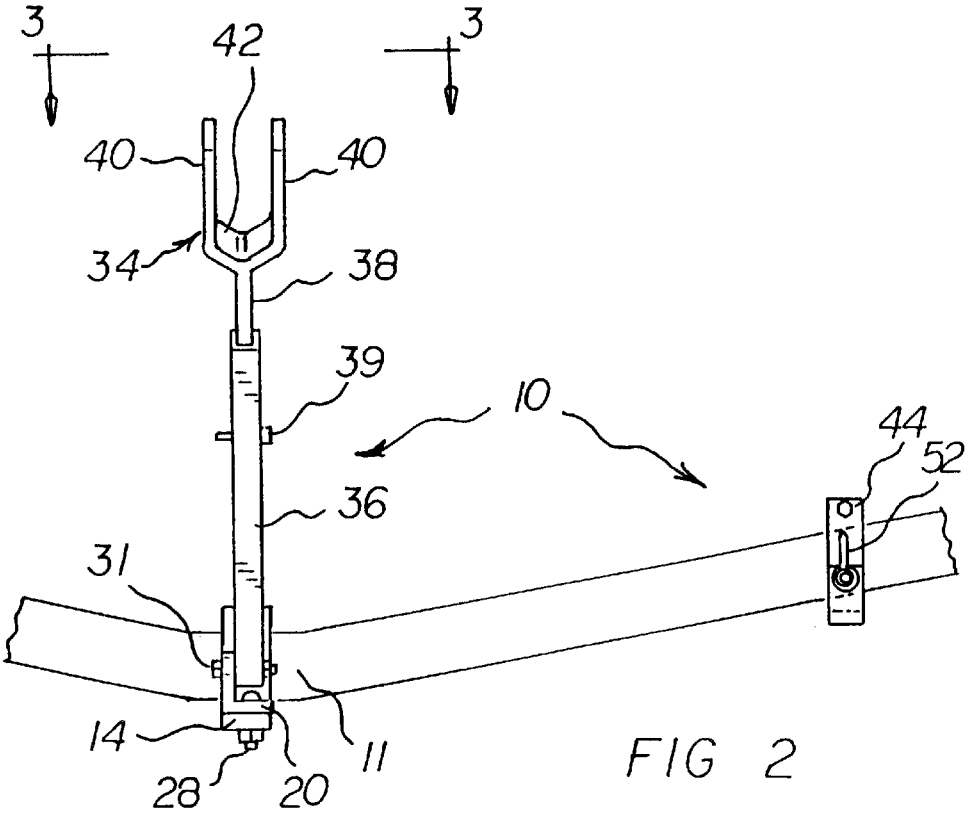
FIG 2

7
15
17
76
90
30'
126
18'
74
70
13'
104
108
7

8
8
40'
40'
90
90
92
92
74
76
30'
44'
103
70
9
98
102
98
13'
126
108
104
102
9

TRANSOM SAVER APPARATUS

CROSS-REFERENCE TO RELATED APPLICATION

This application claims priority based upon my Provisional Application Serial No. 60/204,762, filed May 17, 2000 now abandoned.

BACKGROUND OF THE INVENTION

1. Field of the Invention

The present invention relates generally to devices for protecting transoms of outboard motor boats and, more particularly, to transom protectors that are adapted to be mounted on boat trailers.

2. Description of the Prior Art

When an outboard motor is mounted on a boat, and the boat is transported on a trailer, it is important that the transom of the outboard motor boat be protected from potential damage that may be caused by the lower unit or portion of the outboard motor bumping up against the transom of the boat when the boat is on the trailer during transportation. In this respect, throughout the years, a number of innovations have been developed relating to transom protectors mounted on boat trailers, and the following U.S. patents are representative of some of those innovations: U.S. Pat. Nos. 4,331,431, 4,685,888, and 5,525,082. More specifically, U.S. Pat. No. 4,331,431 discloses a boat-trailer-mounted transom protector which slides under or into the trailer when the transom protector is not in use. In this respect, the transom protector is supported by a single bracket when the transom protector is not in use. As a result, there may be a tendency for the stored transom protector to rattle and shake when the trailer is used, and the transom protector is in a stored condition. Unnecessary rattles and noises are undesirable, and in this regard, it would be desirable if a transom protector were provided which has a reduced tendency to rattle and shake when the transom protector is in a stored condition and attached to a trailer. Also, if stored under a trailer, there would be a tendency for the transom protector to pick up road dirt when the trailer is moved, without the outboard motor being present on the trailer. In this respect, it would be desirable if a transom protector were provided which is not stored under a trailer when the transom protector is not in use.

Both of U.S. Pat. Nos. 4,685,888 and 5,525,082 disclose transom protectors which are retracted into a trailer when the respective transom protector is not in use. For a transom protector to be retractable into a trailer, the trailer must have a suitable hollow space, opening at the rear of the trailer, to receive the transom protector. However, not all boat trailers have such a hollow space that opens at the rear of the trailer. Therefore, the transom protectors in U.S. Pat. Nos. 4,685,888 and 5,525,082 could not be stored in such trailer. To avoid the need for a boat trailer to have a hollow transom saver reception space, it would be desirable if a transom protector could be stored on an outside portion of a boat trailer.

In addition, the following U.S. patents may also be of interest. U.S. Pat. No. 4,271,548 discloses a transom protector that provides a barrier between the transom and any motor mounted on the transom. U.S. Pat. No. 4,381,069 discloses an outboard motor carrier for a motor vehicle, such as a pickup truck.

Still other features would be desirable in a transom saver apparatus. For example, it would be desirable if a transom protector were provided which could be retrofitted to a wide variety of boat trailers. Also, rather than being retracted into a hollow space in a boat trailer, it would be desirable if a transom protector were provided that could be swung on the outside of a boat trailer to and from a use and nonuse condition. Also, it would be desirable if a transom protector were provided which had an extensible arm to enable the transom protector to be useful with a wide variety of boat trailers and transoms. In addition, to prevent rattling of a transom protector it would be desirable if an arm rest bracket were provided that attaches to a trailer and that can secure a transom protector on the trailer when the transom protector is not in use.

Thus, while the foregoing body of prior art indicates it to be well known to use transom protectors attached to boat trailers, the prior art described above does not teach or suggest a transom saver apparatus which has the following combination of desirable features: (1) has a reduced tendency to rattle and shake when the transom protector is in a stored condition and is attached to a trailer; (2) is not stored under a trailer; (3) is stored on a outside portion of a boat trailer; (4) can be retrofitted to a wide variety of boat trailers; (5) can be swung on the outside of a boat trailer to and from a use and nonuse condition; (6) has an extensible arm to enable the transom protector to be useful with a wide variety of boat trailers and transoms; and (7) has an arm rest bracket that is attached to a trailer and that can secure a transom protector on the trailer when the transom protector is not in use. The foregoing desired characteristics are provided by the unique transom saver apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a transom saver apparatus which is adapted to be attached to a boat trailer and includes an arm assembly, and a first bracket assembly adapted to be connected to a first portion of the trailer. The first bracket assembly includes a first trailer connection portion, a baseplate portion connected to said first trailer connection portion, and an arm assembly connection member mounted for pivotal movement on the baseplate portion by a first pivot member defining a first pivot axis normal to the baseplate portion. The arm assembly connection member has a second pivot member defining a second pivot axis perpendicular to the first pivot axis whereas the arm assembly has a first end and a second remotely extending distal end. The first end of the arm assembly is connected to the second pivot member of the arm assembly connection member for pivotal movement about the second axis such that the remotely extending second end of the arm assembly is adapted to be placed in supporting relation to the lower unit of an outboard motor carried on a boat trailer. The arm assembly includes a first telescopic arm member, and a second telescopic arm member in telescopic engagement with the first telescopic arm member wherein the second telescopic arm member defines the second end of the arm assembly and the second end comprises an outboard motor rest unit. At least one lock member for locking said first telescopic arm member and said second telescopic arm member in a selected adjusted position is provided wherein the outboard motor rest unit includes a pair of struts which converge at a V-shaped juncture. An arm rest bracket assembly is further included for receivingly supporting the arm assembly in an out-of-the-way orientation when the arm assembly is not in a pivotally disposed use orientation.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved transom saver apparatus which has all of the advantages of the prior art and none of the disadvantages.

It is another object of the present invention to provide a new and improved transom saver apparatus which may be easily and efficiently manufactured and marketed.

It is a further object of the present invention to provide a new and improved transom saver apparatus which is of durable and reliable construction.

An even further object of the present invention is to provide a new and improved transom saver apparatus which is susceptible of a low cost of manufacture with regard to both materials and labor, and which accordingly is then susceptible of low prices of sale to the consuming public, thereby making such transom saver apparatus available to the buying public.

Still yet a further object of the present invention is to provide a new and improved transom saver apparatus which has a reduced tendency to rattle and shake when the transom protector is in a stored condition and is attached to a trailer.

Still another object of the present invention is to provide a new and improved transom saver apparatus that is not stored under a trailer.

Yet another object of the present invention is to provide a new and improved transom saver apparatus which is stored on a outside portion of a boat trailer.

Even another object of the present invention is to provide a new and improved transom saver apparatus that can be retrofitted to a wide variety of boat trailers.

Still a further object of the present invention is to provide a new and improved transom saver apparatus which can be swung on the outside of a boat trailer to and from a use and nonuse condition.

Yet another object of the present invention is to provide a new and improved transom saver apparatus that has an extensible arm to enable the transom protector to be useful with a wide variety of boat trailers and transoms.

Still another object of the present invention is to provide a new and improved transom saver apparatus which has an arm rest bracket that is attached to a trailer and that can secure a transom protector on the trailer when the transom protector is not in use.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of the transom saver apparatus of the invention installed on a boat trailer.

FIG. 2 is a rear view of the embodiment of the transom saver apparatus shown in FIG. 1 taken along line 2—2 of FIG. 1.

DESCRIPTION OF THE PREFERRED EMBODIMENT

Figure 3:
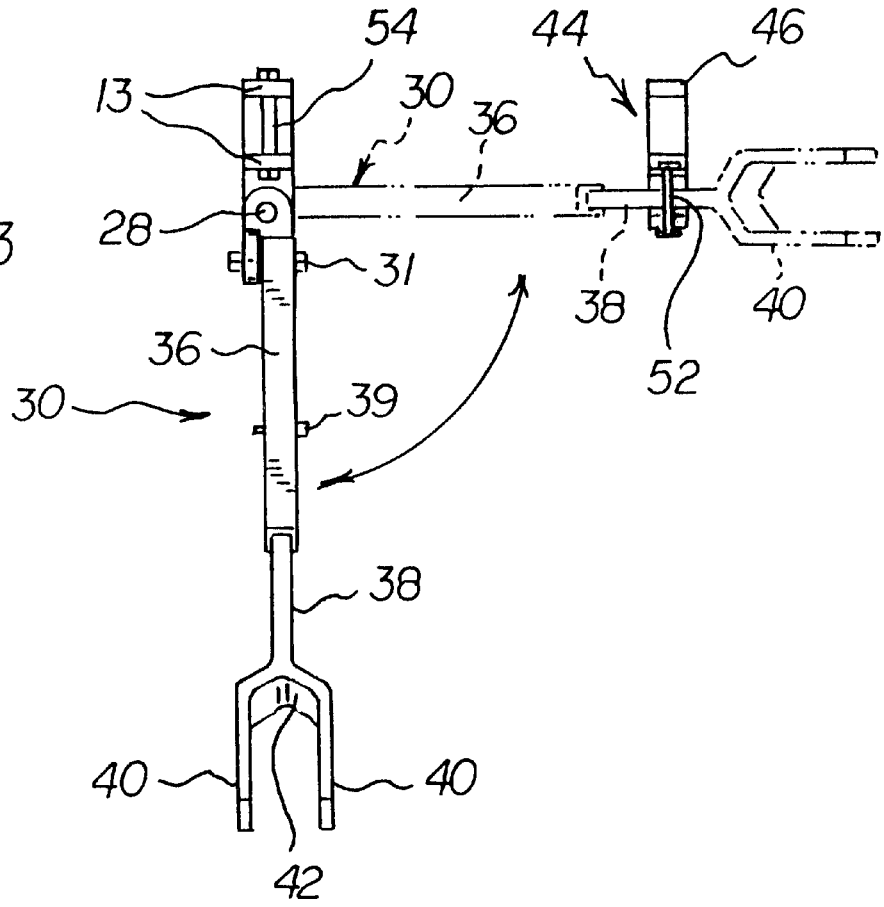
FIG. 3 is a top view of the embodiment of the transom saver apparatus of FIG. 2 taken along line 3—3 thereof.

With reference to the drawings, a new and improved transom saver apparatus embodying the principles and concepts of the present invention will be described.

Turning to FIGS. 1–5, there is shown a first exemplary embodiment of the transom saver apparatus of the invention generally designated by reference numeral 10. In its first preferred form, a transom saver apparatus 10 is shown in FIGS. 1 and 2 attached to a boat trailer rear portion 11. The transom saver apparatus 10 includes a first bracket 12 connected to a first portion of the trailer 11 with a first trailer connection portion 13. A first bracket tang 14 is connected to the first trailer connection portion 13, and a first hinge pin reception channel 16 is located in the first bracket tang 14. A second bracket 18 includes a base tang 20 which has a second hinge pin reception channel 22, and a riser tang 24 extends upward from the base tang 20. The riser tang 24 includes a third hinge pin reception channel 26. A first hinge pin 28 is received in the first hinge pin reception channel 16 and the second hinge pin reception channel 22 for connecting the first bracket 12 and the second bracket 18 together. An arm assembly 30 includes a fourth hinge pin reception channel 32 at a first arm end and includes an outboard motor rest unit 34 at a second arm end. A second hinge pin 31 is received in the third hinge pin reception channel 26 and the fourth hinge pin reception channel 32 for connecting the second bracket 18 and the arm assembly 30 together.

The riser tang 24 is perpendicular to the base tang 20. The second hinge pin reception channel 22 is oriented along a first axis 23, and the third hinge pin reception channel 26 is oriented along a second axis 27, wherein the first axis 23 is perpendicular to the second axis 27.

The arm assembly 30 includes a first telescopic arm member 36 which includes the fourth hinge pin reception channel 32. A second telescopic arm member 38 is in telescopic engagement with the first telescopic arm member 36. The second telescopic arm member 38 includes an outboard motor rest unit 34, and a lock pin 39 is provided for locking the first telescopic arm member 36 and the second telescopic arm member 38 together in a selected adjusted position. The motor rest unit 34 includes a pair of struts 40 which converge at a V-shaped juncture 42.

An arm rest bracket 44 is connected to a second portion of the trailer 11. The arm rest bracket 44 includes a trailer connection portion 46 and an arm rest reception portion 48. The arm rest reception portion 48 includes an arm receiver channel 50 for receiving a portion of the arm assembly 30. An arm locking assembly 52 is provided for locking a received arm assembly 30 in the arm rest reception portion 48.

Use of the transom saver apparatus 10 of the invention is shown in FIG. 1. The first trailer connection portion 13 of the first bracket 12 is attached to a first portion of a boat trailer 11 using nut and bolt assembly 54. With a person grasping the arm assembly 30, the second bracket 18 is swung around the first bracket 12 around first hinge pin 28, which is secured to the brackets by nut 58. The arm assembly 30 is swung around the second bracket 18 on second hinge pin 31, which is secured to the bracket and the arm assembly by nut 60. The lock pin 39 is removed from engagement with the first telescopic arm member 36 and the second telescopic arm member 38, and the second telescopic arm member 38 is moved towards the outboard motor lower unit 15 schematically shown in FIG. 1. In this respect, the outboard motor rest unit 34 is moved towards the motor 15 so that a V-shaped portion of the motor lower unit 15 rests on the complimentary V-shaped juncture 42 of the rest unit 34 between the pair of struts 40. When the rest unit 34 engages the motor lower unit 15, the lock pin 39 is placed through adjustment channels 37 in the first telescopic arm member 36 and through registered adjustment channels 41 in the second telescopic arm member 38. The lock pin 39 prevents the motor rest unit 34 from moving away from the motor 15 longitudinally, and the V-shaped juncture 42 and the struts 40 prevent the rest unit 34 from moving away from the motor lower unit 15 laterally. As a result, the arm assembly 30 serves as a rigid strut stabilizing the motor unit 15 as the trailer 11 rides over road surfaces and preventing the motor unit bumping into the transom 17 of the boat carried on the trailer.

Figure 4:
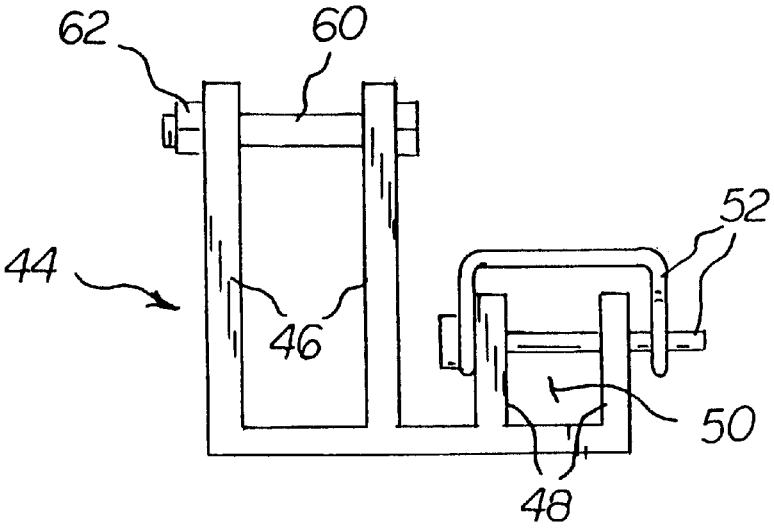
FIG. 4 is an enlarged side view of the transom saver holder bracket that is used to hold the transom saver rest when the transom saver rest is not in use.
Figure 5:
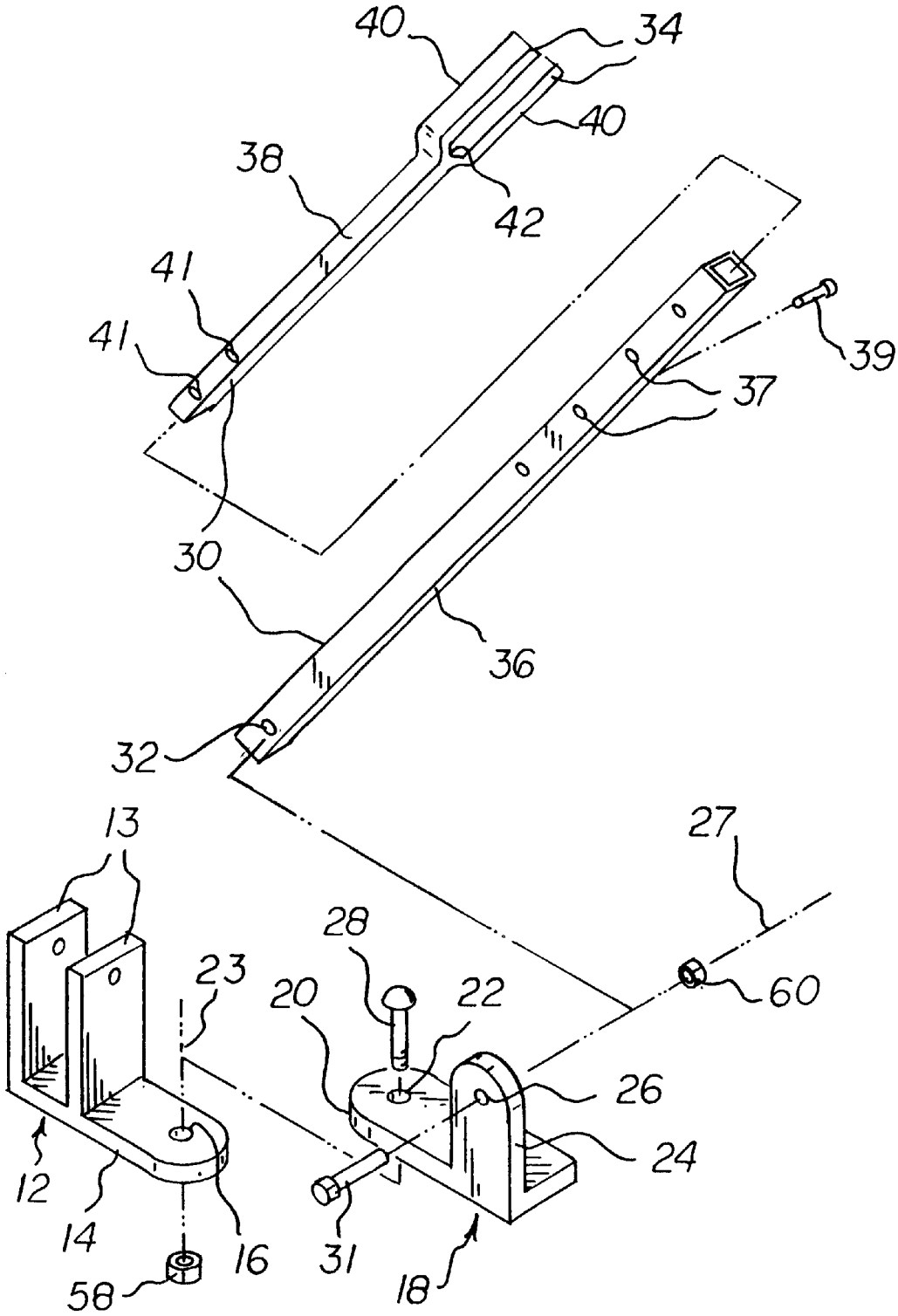
FIG. 5 is an exploded perspective view of the embodiment of the invention shown in FIGS. 1–4, excluding the transom saver holder bracket.

When the boat (only partially shown) is to be removed from the trailer 11, the lock pin 39 is removed from the arm assembly 30, and the second telescopic arm member 38 is moved away from the motor unit 15 and further into the first telescopic arm member 36. As a result, the motor lower unit 15 is free from contact with the transom saver apparatus 10 of the invention. When the transom saver apparatus 10 of the invention is not in use stabilizing a motor unit 15, the arm assembly 30 is secured to a second position on the trailer 11. An arm rest bracket 44 is connected to a second portion of the trailer 11, between trailer connection portions 46, by bolt 60 and nut 62. More specifically, as shown in FIG. 3 in broken lines and as illustrated in FIG. 4, the arm assembly 30 is swung around the first hinge pin 28 and the second hinge pin 31 so that the second telescopic arm member 38 is received in the arm receiver channel 50 between the arm rest reception portions 48 of the arm rest bracket 44. Then, the lock pin 39 is placed in registered adjustment channels in the respective first telescopic arm member 36 and second telescopic arm member 38. Then, the arm locking assembly 52 is locked onto the arm rest bracket 44 to secure the second telescopic arm member 38 into engagement with the arm rest bracket 44.

To use the transom saver apparatus 10 once again for stabilizing the lower unit of an outboard motor 15 when the boat is transported on the trailer 11, the arm locking assembly 52 is unlocked from the arm rest bracket 44, the second telescopic arm member 38 is swung away from the arm rest bracket 44, and the arm assembly 30 is used for stabilizing the motor unit 15 as described above.

Turning to FIGS. 6–10, there is shown an alternative, mostly preferred embodiment of the present invention generally indicated by reference 10'. As in the first embodiment, this alternatively preferred embodiment of the invention generally comprises an arm assembly 30', a first trailer connection bracket 13' for pivotally supporting the arm assembly on a first portion of a trailer or the like, and a second trailer connection bracket 44' for supporting the end of the arm assembly on a trailer or the like when the transom saver is not in use.

Figure 6:
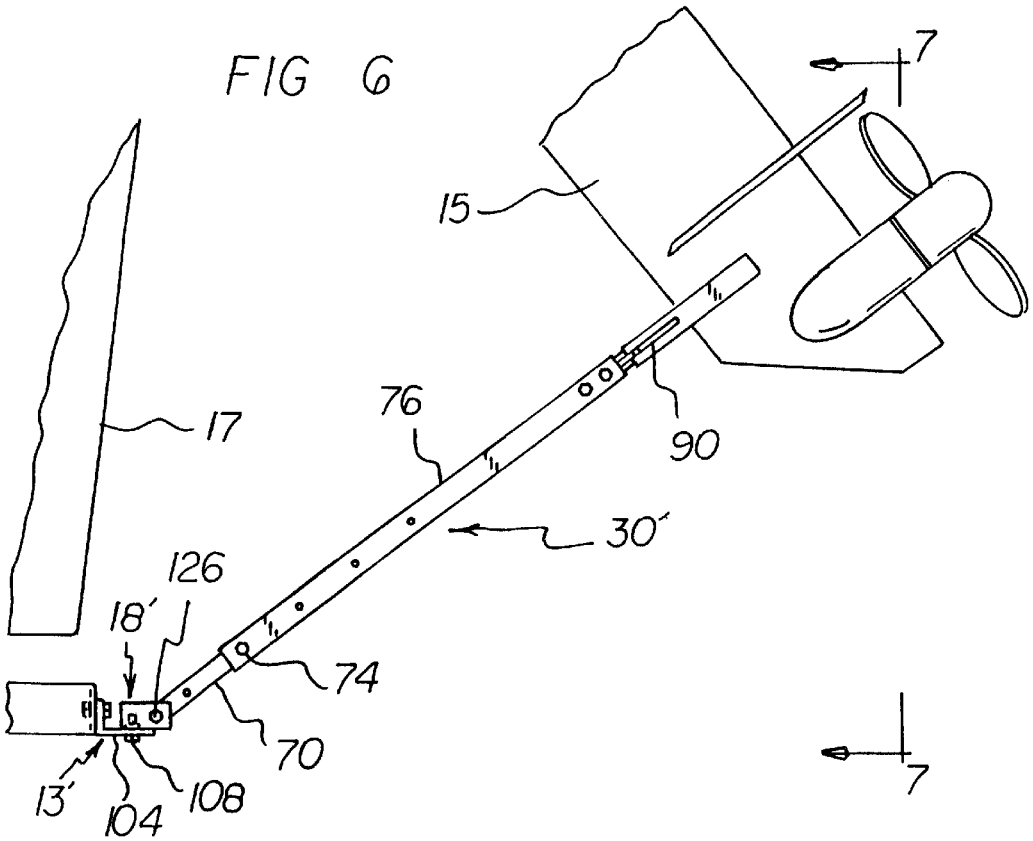
FIG. 6 is a side view showing an alternatively preferred embodiment of the transom saver apparatus of the invention installed on a boat trailer.
Figure 7:
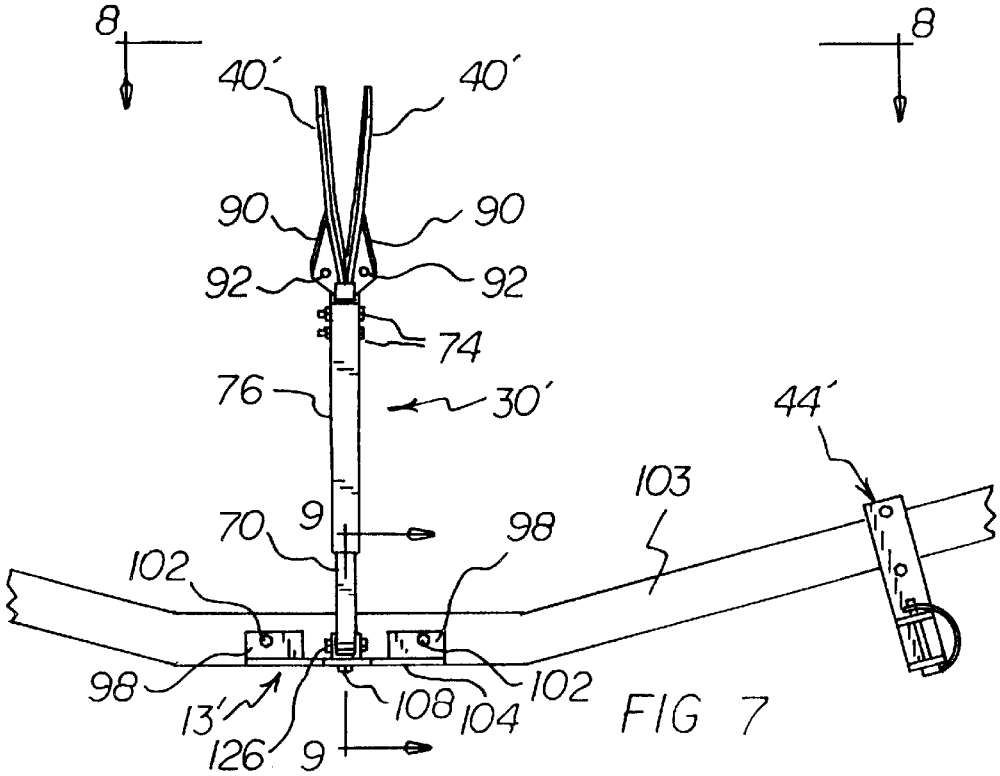
FIG. 7 is a rear view of the embodiment of the transom saver apparatus shown in FIG. 6 taken along line 7—7 of FIG. 6.
Figure 8:
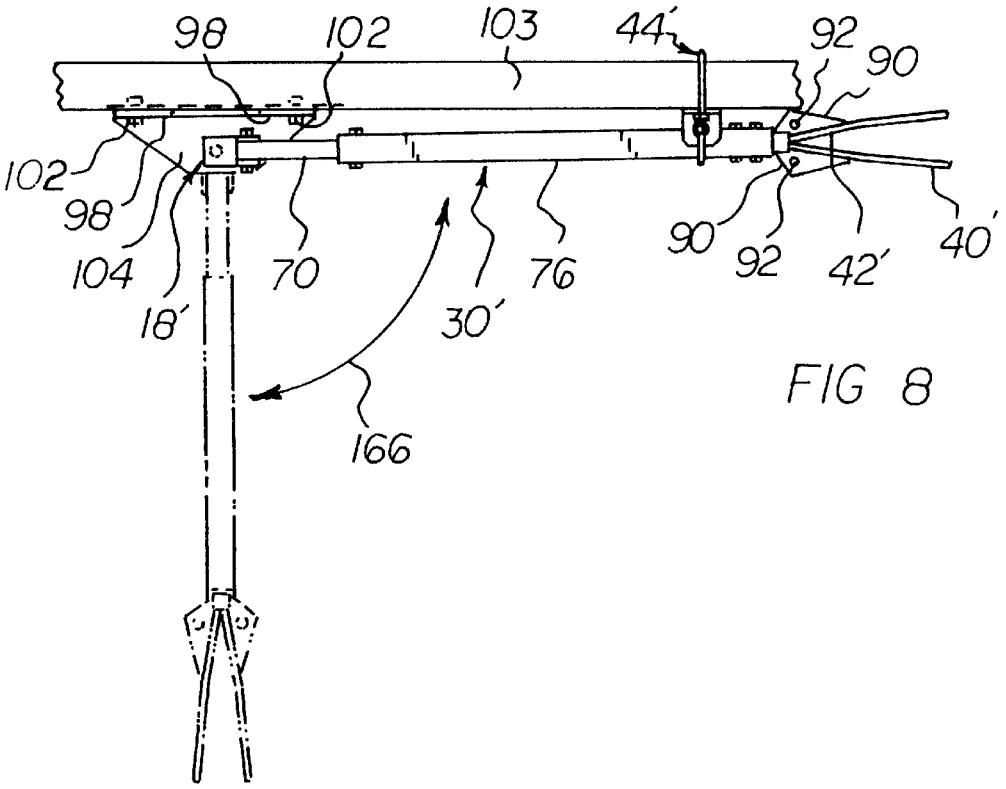
FIG. 8 is a top view of the embodiment of the transom saver apparatus of FIG. 7 taken along line 8—8 thereof.
Figure 10:
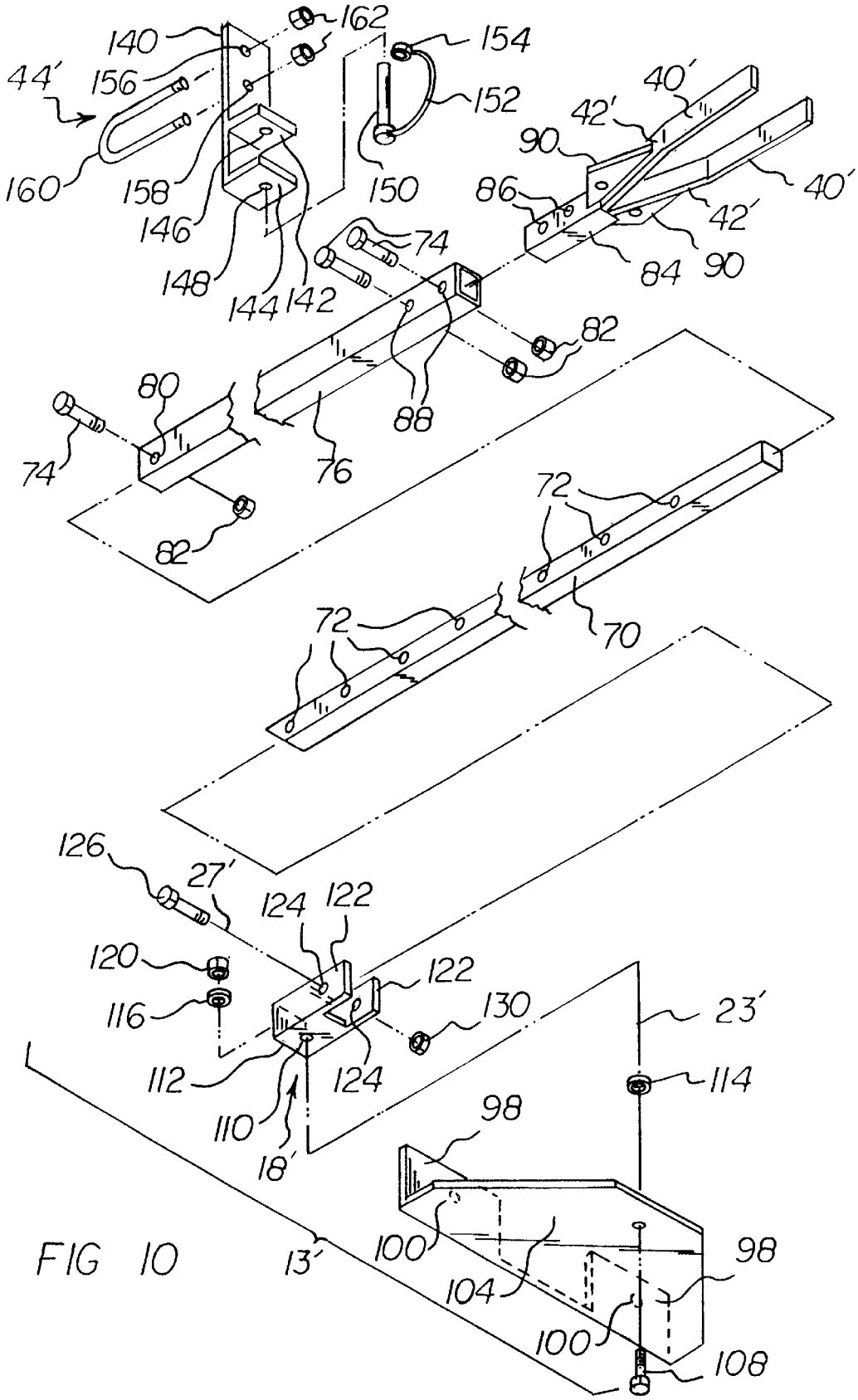
FIG. 10 is an exploded perspective view of the alternatively preferred embodiment of the invention shown in FIGS. 6–8.

Referring to FIG. 10, arm assembly 30' in turn, comprises a first arm member 70 having a series of substantially evenly longitudinally spaced through apertures 72 for receiving an adjustment locking pin or fastener 74. Arm assembly 30' additionally comprises a second arm member 76 in the form of a channel or sleeve 78 adapted to be telescopically slidingly received on first arm member 70. Second arm member 76 includes a through aperture 80 proximal to one end thereof as substantially shown in FIG. 10. When the second arm member is slidingly adjusted to a selected telescopically oriented longitudinal position relative to and on the first arm member, the two parts may be fastened together by passing fastener 74 through the aligned apertures 80, 72. Fastener 74 can be a threaded bolt held in place by a conventional nut 82. Arm assembly 30' yet additionally comprises a third arm member 84 adapted to be received within the opposed open end of sleeve 76 which third arm member terminates distally in a pair of struts 40' converging at a V-shaped juncture 42'. Third arm member has a pair of longitudinally spaced through apertures 86 whereas the opposed end of second arm member 76 has a like pair of through apertures 88 located proximally to the opposed end thereof substantially as shown (FIG. 10). By this arrangement, third arm member 84 can be telescopically slidingly received in the open end of second arm member 76 until apertures 86 and 88 are aligned. The second arm member and the third arm member then may be fastened together using bolts 74 and nuts 82. It will be appreciated that the length (longitudinal extent) of arm assembly 30' may be adjusted as desired to fit a particular trailer/boat configuration within a relatively wide range merely by removing the fastener from aperture 80, sliding the second arm on the first arm and reinserting the fastener 74 into a new pair of aligned apertures 80 and 72. Finally, it will be noted that a pair of wing plates 90 are provided suitably rigidly affixed to the third arm member 84 and extending oppositely and laterally from V-shaped juncture 42' each with its own through aperture 92 (FIG. 7). Advantageously a strap, bungee cord, or the like (not shown) may be connected from one plate 90 to the other and around the lower unit of motor 15 using the through apertures 92 therein as convenient attachment points for the opposed ends of the strap or bungee cord thereby to enhance stabilization of the motor when it's lower unit is cradled between the struts 40' and V-shaped juncture 42' substantially as depicted in FIG. 6.

As in the first embodiment of the invention, the arm assembly 30' is pivotally carried on first trailer connection bracket 13'. In this regard, bracket 13' comprises a first connection member 12' having an upstanding wall formed by a pair of laterally spaced, rectangularly shaped attachment sections 98 each having a through aperture 100 therein for receiving a corresponding trailer connecting bolt 102. Upstanding attachment sections 98 are adapted to be rigidly and securely fastened to a trailer bumper 103 having suitable through holes 105 therein. Through holes 100 in sections 98 are aligned therewith and a connecting bolt 102 and a suitable complimentary nut fastener 107 can be employed to attach the first connection member 12' to the trailer bumper 103 (FIGS. 7 and 9).

The upstanding attachment sections 98 have joined thereto an orthogonally extending base plate 104 having a through hole or aperture 106 intermedially therein substantially as shown. An arm assembly connection member 18' is mounted for pivotal movement on baseplate 104 by means of a bolt 108 extending through aperture 106 and a suitable aligned through aperture 110 located in the bottom wall 112 of connection member 18'. More specifically, bolt 108 passes through hole 106 in baseplate 104, a first washer 114, hole 110 in bottom wall 112, a second washer 116, and nut fastener 120 to securely maintain connection member 18' on baseplate 104 yet permit easy pivotal movement of connection member 18' about an axis 23' passing longitudinally and centrally through bolt 108 which axis 23' is normal to the plane of baseplate 104.

Figure 9:
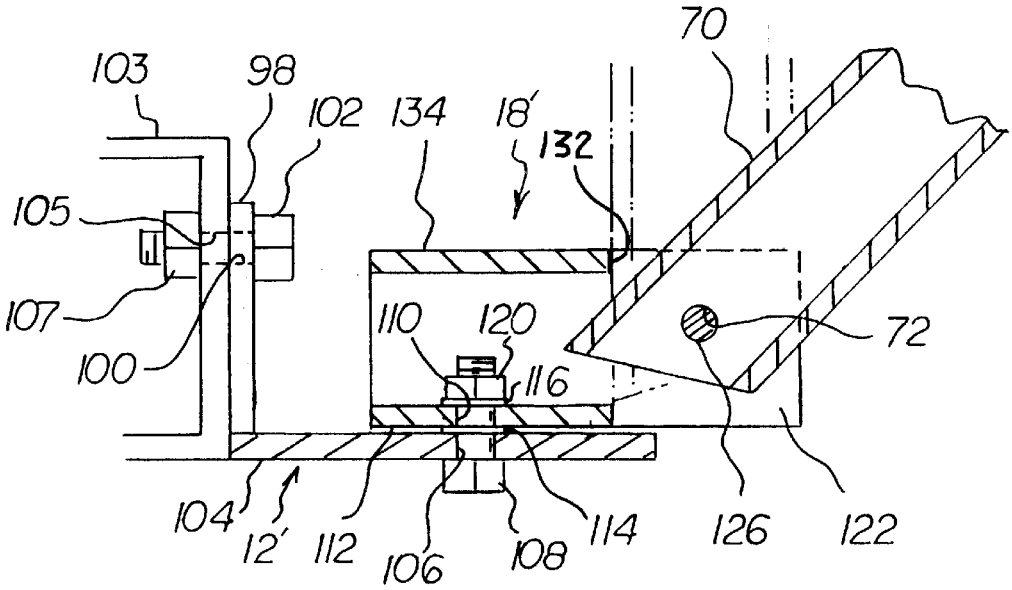
FIG. 9 is an enlarged side cross-sectional view of a fragmentary portion of the arm assembly and arm assembly support bracket according of the alternatively preferred embodiment of the FIGS. 7 and 8.

As best seen in FIGS. 9 and 10, connection member 18' also has a pair of spaced, parallel sidewalls 122 extending laterally with respect to through aperture 110 and having respectively aligned through openings or apertures 124 adapted to receive therethrough a pivot bolt 126 which, in turn, is used to pivotally attach first arm 70 of arm assembly 30' to the connection member 18'. This may be accomplished by aligning the aperture 72 proximal to end 128 of first arm 70 between apertures 124 in extensions 122 and passing pivot bolt 126 therethrough whereupon bolt 126 may be secured in place by a suitable complimentary female threaded nut fastener 130 or the like. Pivot bolt 126 permits the arm assembly to move up and down as viewed in FIG. 6 about an axis 27' passing longitudinally and centrally through bolt 126. Thus, in accordance with the invention, the arm assembly 30' easily and conveniently may be raised into a suitable motor lower unit support position substantially as depicted in FIG. 6. In this regard, it will be observed in connection with FIG. 9, that the arm assembly 30' is capable of rotating to a full vertical position or until the leftmost edge of first arm portion 70 abuts against and is limited by the righthand or leading edge 132 of the top wall 134 of connection member 18'.

In the alternative embodiment of FIGS. 6–10, the second trailer connection bracket 44' for stowing or supporting the end of the arm assembly 30' on a trailer or the like when the transom saver is not in use, comprises an attachment plate 140 having a pair of orthogonally extending spaced walls 142, 144 affixed thereto. Each wall has a through aperture 146, 148 for suitably receiving a locking pin 150 such that the axis of the pin lies parallel to but is spaced from the surface of the plate 140 (i.e. the apertures 146, 148 are substantially aligned with one another). The pin 150 includes an enlarged head (not labeled) and a lanyard or flexible strap 152 attached at one end thereof to the pin in the vicinity of the enlarged head. Attached at the other end of the lanyard or strap 152 is a locking cap 154 suitably adapted to be securely snap-fitted on the distal end of the locking pin after the pin is received through the aligned apertures 146, 148. A pair of through apertures 156, 158 is located in the plate 140 above the orthogonal walls 142, 144 substantially centrally of the upper region of the plate as shown. The apertures 156, 158 are adapted suitably to receive the freely extending legs of a U-shaped fastener 160 the ends of which are externally threaded to mate with complimentary female threaded fasteners such as lock nuts 162 or the like after the ends of fastener 160 are inserted through apertures 156, 158. The U-shaped fastener 160 and locking nuts 162 conveniently may be used to securely affix plate 140 at a selected location along the trailer bumper 103 remote with respect to the first trailer connection bracket 13' (FIGS. 7 and 8) such that a distal end portion of second arm member 76 (arm assembly 30') may be supported in the reception channel defined by the space between orthogonal walls 142 and 144, and temporarily securely maintained in that position by use of lanyard 152 and locking cap 154 suitably snap-fitted on the distal end of locking pin 150. In this manner, when the arm assembly 30' is not in use supporting the lower unit of an outboard motor 15 away from the transom of a boat loaded on a trailer, the arm assembly 30' (and the arm connection member 18') may be rotated about axis 23' defined by bolt 108 in the direction of arrow 166 (FIG. 8), and rotated about axis 27' defined by bolt 126, whereupon the arm assembly conveniently may be stowed in a position generally parallel to the trailer bumper 103 as aforesaid (see FIG. 8). When it is desired to use the arm assembly in accordance with the invention, after a boat is loaded on the trailer, the locking cap 154 merely is removed from the distal end of the locking pin 150 freeing the arm assembly for rotation to a use position as indicated by the broken line outline in FIG. 8. In essentially all other respects, operation of second embodiment of the invention is similar to that of the first described embodiment.

The components of the transom saver apparatus of the invention can be made from inexpensive and durable metal and plastic materials.

As to any additional advantageous modes of usage and/or operation of the instant invention, the same should be readily apparent to a person of ordinary skill from the above detailed disclosure, and accordingly, no further discussion relative to such additional modes of usage and operation need be provided.

It is apparent from the above that the present invention accomplishes all of the objects set forth by providing a new and improved transom saver apparatus that is low in cost, relatively simple in design and operation, and which may advantageously has a reduced tendency to rattle and shake when the transom protector is in a stored condition and is attached to a trailer. With the invention, a transom saver apparatus is provided which is not stored under a trailer. With the invention, a transom saver apparatus is provided which is stored on a outside portion of a boat trailer. With the invention, a transom saver apparatus is provided which can be retrofitted to a wide variety of boat trailers. With the invention, a transom saver apparatus is provided which can be swung on the outside of a boat trailer to and from a use and nonuse condition. With the invention, a transom saver apparatus is provided which has an extensible arm to enable the transom protector to be useful with a wide variety of boat trailers and transoms; and With the invention, a transom saver apparatus is provided which has an arm rest bracket that is attached to a trailer and that can secure a transom protector on the trailer when the transom protector is not in use.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A transom saver apparatus adapted to be attached to a trailer, comprising:

an arm assembly, a first bracket assembly adapted to be connected to a first portion of said trailer, wherein said first bracket assembly includes a first trailer connection portion, and a baseplate portion connected to said first trailer connection portion, and an arm assembly connection member mounted for pivotal movement on said baseplate portion by a first pivot member defining a first pivot axis normal to said baseplate portion, said arm assembly connection member having a second pivot member defining a second pivot axis perpendicular to said first pivot axis, said arm assembly having a first end and a second remotely extending distal end, said first end of said arm assembly being connected to said second pivot member of said arm assembly connection member for pivotal movement about said second axis such that said remotely extending second end of said arm assembly is adapted to be placed in supporting relation to the lower unit of an outboard motor carried on said trailer, said apparatus further including:

an arm rest bracket connected to a section portion of said trailer, wherein said arm rest bracket includes a trailer connection portion and an arm rest reception portion, and wherein said arm rest reception portion is adapted to receive a portion of said arm assembly when said arm assembly connection member is pivoted about said first axis and said arm assembly is pivoted about said second axis, and an arm support assembly for supporting a received arm assembly in said arm rest reception portion.

2. The apparatus of claim 1 wherein:

said arm assembly includes:

a first telescopic arm member, and a second telescopic arm member in telescopic engagement with said first telescopic arm member, wherein said second telescopic arm member defines the remotely extending second end of said arm assembly, and said second end of said arm assembly comprises an outboard motor rest unit, and at least one lock member for locking said first telescopic arm member and said second telescopic arm member in a selected adjusted position.

3. The apparatus of claim 2 wherein said rest unit includes a pair of struts which converge at a V-shaped juncture.

4. The apparatus of claim 1 wherein said arm support assembly comprises a locking pin and said arm rest reception portion includes at least one locking pin reception channel, said locking pin being insertably received into said at least one locking pin reception channel to retain said received arm assembly in said arm rest reception portion.

5. The apparatus of claim 4 further including a locking cap suitably adapted to be securely snap-fitted on the distal end of said locking pin after said locking pin is received into said at least one locking pin reception channel.

6. The apparatus of claim 5 further including a flexible strap for attaching said locking cap to said locking pin.

* * * * *